United States Patent [19]

Densch

[11] Patent Number: 4,968,234

[45] Date of Patent: Nov. 6, 1990

[54] ROTARY PISTON MACHINE WITH SEALING ELEMENTS

[76] Inventor: Dietrich Densch, Am Gansberg 14, 5206 Neunkirchen-Seelscheid, Fed. Rep. of Germany

[21] Appl. No.: 391,553

[22] PCT Filed: Dec. 31, 1987

[86] PCT No.: PCT/DE87/00610

§ 371 Date: Jun. 30, 1989

§ 102(e) Date: Jun. 30, 1989

[87] PCT Pub. No.: WO88/05119

PCT Pub. Date: Jul. 14, 1988

[30] Foreign Application Priority Data

Dec. 31, 1986 [DE] Fed. Rep. of Germany ..... 3644787
Dec. 31, 1986 [DE] Fed. Rep. of Germany ..... 3644833
Mar. 19, 1987 [DE] Fed. Rep. of Germany ..... 3709030

[51] Int. Cl.[5] ..... F01C 1/28; F01C 19/00
[52] U.S. Cl. ..... 418/104; 418/196
[58] Field of Search ..... 418/104, 112, 150, 183, 418/196; 123/241, 246

[56] References Cited

U.S. PATENT DOCUMENTS 2,097,881 11/1937 Hopkins ..... 418/183
3,809,026 5/1974 Snyder ..... 123/8.47
4,324,537 5/1982 Meyman ..... 418/196 X

FOREIGN PATENT DOCUMENTS 3241253 5/1984 Fed. Rep. of Germany ..... 418/196
36923 11/1935 Netherlands ..... 418/196
983318 12/1982 U.S.S.R. ..... 418/150

*Primary Examiner*—John J. Vrablik
*Assistant Examiner*—David L. Cavanaugh
*Attorney, Agent, or Firm*—Eckert, Seamans, Cherin & Mellot

[57] ABSTRACT

A rotary piston machine includes, arranged inside the gas-tight inner chamber (22) of a housing (24), a piston assembly (20) having at least three separate pistons (26) of identical design in the form of rectilinear prisms having front faces limited by several arcs of a circle (28, 30). The pistons are each fixedly secured to and turn in the same direction (36) as a shaft (34) rotatably mounted in the housing, extending through the geometric central axis and the rotation of which is synchronized by means of a gear, have flushed front faces and laterally limit the inner working space (38) with their curved circumferences, leaving a gap (S) between adjacent rotary pistons (26). Sealing elements (42) mounted in each gap (S) have two parallel sealing bars (44, 46) which have a cross section that is wider than the gap (S) are mutually linked by a connecting piece (48) narrower than the gap (S), and have a length that substantially corresponds to the length of the rotary pistons (26).

9 Claims, 2 Drawing Sheets

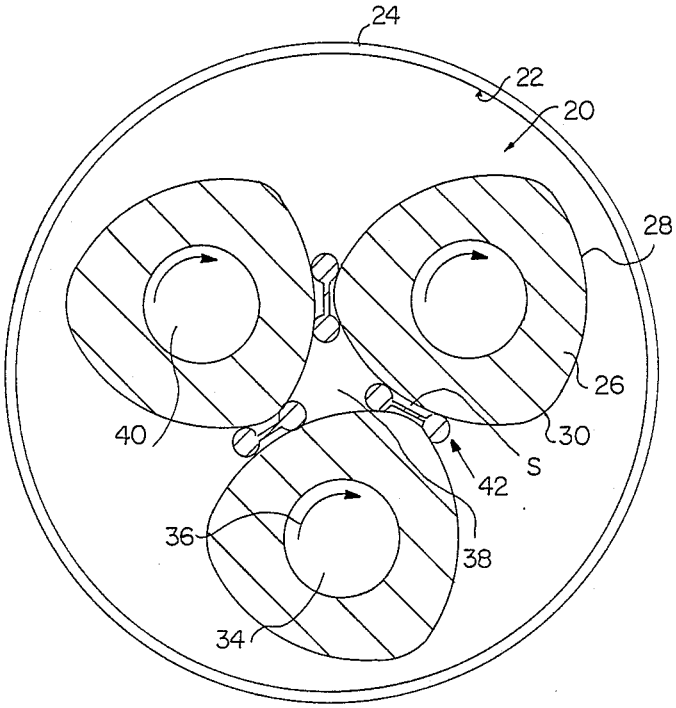
FIG. 1
FIG. 2
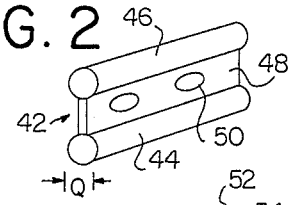
FIG. 3
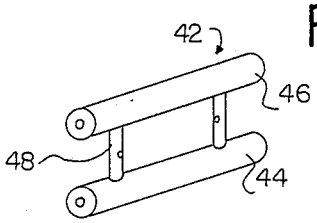
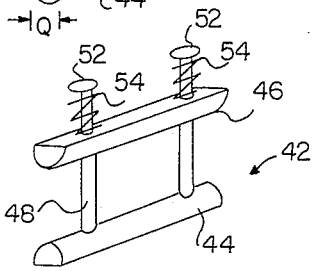
FIG. 4
FIG. 5
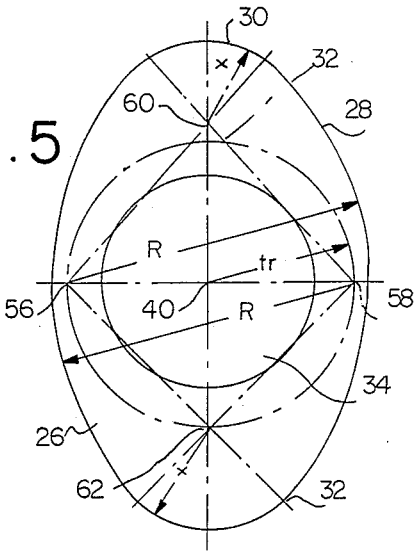

ROTARY PISTON MACHINE WITH SEALING ELEMENTS

Figure 8:
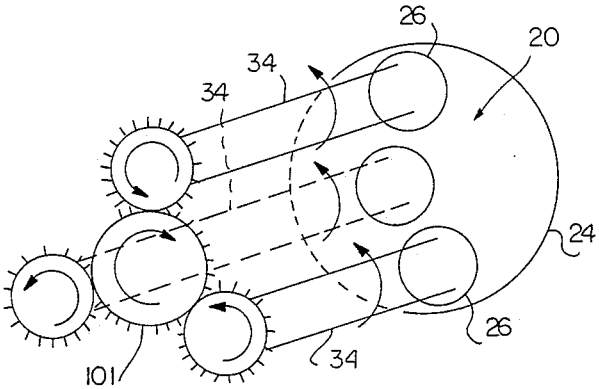

The invention relates to a rotary piston machine with sealing elements. In the case of the rotary piston machine with sealing elements of this kind previously known from U.S. Pat. No. 3,809,026, the rotors are elliptical in cross-section and the sealing elements are constructed of round sealing bars, which are mutually linked by the connecting piece. Due to this design, generally only one or two sealing bars of a sealing element are in contact with the rotor's convex surfaces, the other sealing bar is free and protrudes without contact; this is illustrated in FIG. 8 of the patent text quoted. The sealing elements are thus not guided, and must be brought into the sealing position by auxiliary means, for example by the inner pressure.

This is where the invention steps in. It has as its objective the improvement of the sealing system of a specific rotary piston machine which has an inner working space limited only by at least three rotary pistons.

On this basis the invention proposes for the solution of this objective that the front faces of the rotary pistons are limited by several arcs, which have two different radii R, r, of which the arc pieces with the same radius R or r each have arc lengths equal to one another, which are alternately placed in contact at connection points and tangentially blend into one another at these points, which are torsionally stiffly connected with the shafts respectively allocated to them, which shafts are rotatively mounted in the housing, extend along their geometric central axis, and are rotationally synchronized with each other by means of a gear, with which they are rotatable in the same direction of turn, which have front faces arranged flush with one another, and which limit laterally an inner working space by means of their curved peripheral surfaces, whereby the radial spacing of the axis lines of the shafts is greater than the sum (R+r) of the two different radii R, r by the dimension of a gap S between the adjacent rotary pistons, and the sealing bars each have the profile section of an isosceles, blunted triangle, whereby the corners of the triangle point towards each other, the bases extend parallel to one other and the relationship $$\cos \text{phi} = \frac{r + R}{r + R + S' - K}$$

applies for the angle phi between the connecting line of the opposing blunted corners of the isosceles triangle and its sides, whereby K is the distance between the respective parallel sides projected onto a line parallel to the bases, and K can be positive, negative or zero.

Such sealing elements are of simple design and are thus also simple to manufacture; they are axially insertable into the gap between two adjacent rotary pistons and in this way are easily mounted. Due to this they can also be easily replaced, by removing a front panel from the housing.

The sealing elements are not fixedly secured to the rotary pistons, which they seal off from one another, rather, they are kept in place by the fact that the one sealing bar is located on the one side of the gap, the other on the other side of the gap, both being identically designed sealing bars, however, having such large cross-section dimensions that they are unable to be moved through the gap. Due to the connecting piece connecting them, they are also unable to move away from each other. They are therefore generally inserted or removed axially between two adjacent rotary pistons. In a preferred embodiment of the invention it is provided that the connection piece be arranged to be detachable on at least one side from the sealing bar located there. For this purpose, the one sealing bar can be connected with the connecting piece, for example, by means of a screw connection, by means of hooks, a clip connection or suchlike. Such detachable sealing elements are favourable for special mounting and dismantling purposes.

The gap between two adjacent rotary pistons is limited by the arcs with their differing radii, from which the rotary pistons are generated. Depending on the relative position of two adjacent rotary pistons to one another, the gap is limited by an arc with a large radius R on the one side and an arc with a smaller radius r on the other side, with a mixed shape of both arcs in the area of the connection points, or with an arc with a small radius r on the one side and an arc with the large radius R on the other side. Thus, when operated in practice, the shape of the gap is constantly changing. Its gap width does indeed remain constant at all times at the narrowest point, but the distance of the curved surfaces of the adjacent rotary pistons changes at a specific distance from this gap.

In other words, access to the gap becomes periodically narrower and wider, whereby, however, the actual gap width remains unchanged.

These changes in the gap must be taken into account in the design of the sealing elements. For this purpose the distance of the two sealing bars transversely to its longitudinal direction, which distance is determined by the connecting piece, has been so selected that the sealing elements always have some play transversely to the gap and in all positions of the rotary pistons relative to one another. This means, however, that the sealing elements constantly move back and forth somewhat during practical operation. In doing so the following processes take place: if the inner working space enclosed by the rotary pistons is pressurized, the sealing bar of each sealing element located inside it will be pushed outwards and brings about a seal. When the engine is rotating, mass inertia forces are added to this, which bring about contact of the one or other sealing bar of the sealing element, depending on whether the gap moves away from or approaches the centre point of the inner combustion chamber due to the rotation of the adjacent rotary piston.

Alternatively it is suggested each of the two sealing bars of the sealing elements be pulled up against one another by means of springs, by which means it is assured that the two sealing bars can indeed move away from one another and moved towards each other respectively, corresponding with the deformation of the gap, and yet both be constantly in seal-tight contact.

By this means it is achieved simultaneously, where there is wear to the sealing bars and possibly to the peripheral surfaces of the rotary pistons, that, despite smaller dimensions, sealing contact is always achieved in the event of wear.

Other advantages and features of the invention follow from the other claims as well as from the following description of practical embodiments by way of examples which are not to be understood as limiting, which examples of practical embodiments are explained in more detail with reference to the drawing. In this FIG. 1 shows a section through a rotary piston machine according to the invention with inserted sealing elements, FIG. 2 an illustration in perspective of a sealing element, FIG. 3 an illustration corresponding with FIG. 2, FIG. 4 an illustration in perspective of a sealing element with an elastic connecting piece, FIG. 5 a front view of a rotary piston FIG. 6 a section through two rotary pistons of a rotary piston machine with a sealing element which is limited by straight lines.

Figure 6:
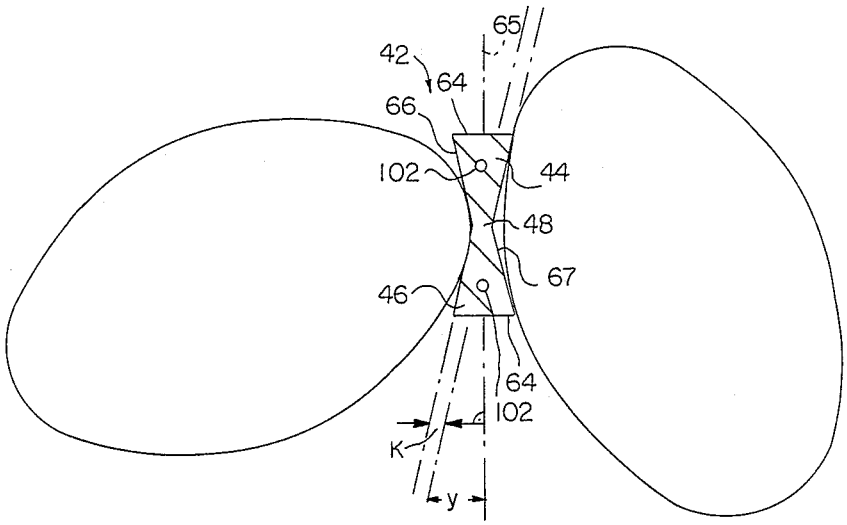
Figure 7:
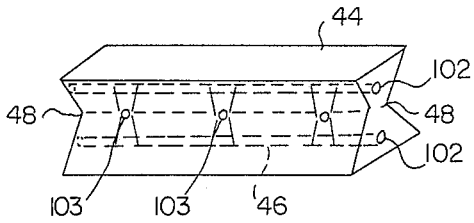

FIG. 7 a side view of the sealing element of FIG. 6.

FIG. 8 an illustration of the gear arrangement for rotating the rotary pistons.

A piston arrangement 20 is shown in FIG. 1 in section of a rotary piston machine, which is located inside a gas-tight inner space 22 of a housing 24. It is formed by three rotary pistons 26 with identical design to one another, which rotary pistons are designed as rectilinear prisms. Their cross-section surfaces can be seen in FIG. 1, the front faces are identical. The front faces are limited by a total of six arc pieces 28, 30 (or four arc pieces 28, 30 in FIG. 5), which have different radii, namely one larger radius R and a smaller radius r. The circular arc pieces with the same radius, R, or r, each have the same base length as one another. The arc pieces 28, 30 are placed in contact with one another alternately at connection points, at these they tangentially blend into each other.

Each rotary piston 26 is allocated with a shaft rotatively mounted in the housing 24, connected to its torsionally stiffly, which extends along its geometric central axis. The separate shafts are rotationally synchronized with each other by means of a gear 101 (see FIG. 8), so that the relative angular position of the separate rotary pistons 26 is retained relative to one another. The rotary pistons 26 are rotatable in the same direction of turn in the direction of an arrow 36. The front faces of the rotary pistons 26 are arranged flush with one another, and are hence located at the respectively same levels.

The three rotary pistons 26 limit laterally by means of their curved peripheral surfaces an inner working space 38 which is limited at its end regions by surfaces of the housing 24.

The radial distance of the axis lines 40 of the shafts 34 of adjacent rotary piston 26 is greater than the sum of the two different radii by the dimension of a gap S, thus R+r. Due to this, said gap S remains free between adjacent rotary pistons 26. Its gap width S' at the narrowest point is constant by virtue of the shape of the rotary pistons 26 and their geometric arrangement on the shafts 34.

The seal tightness between adjacent rotary pistons 26 is achieved by sealing elements 42; in total equally as many sealing elements 42 are provided as gaps S between the rotary pistons 26. The sealing elements are composed of two sealing bars 44, 46, which are parallel to one other, and a connecting piece 48 linking these. The sealing bars 44, 46 are preferably designed identically and have the length of the rotary pistons 26. They have a cross-section width Q which is greater than the width of the gap S, due to which it is prevented that it is able to slip through the gap S. The two sealing bars 44, 46 of a sealing element are located on both sides of the gap S. The connecting piece 48 transverse the gap itself, which piece is narrower than the width of the gap S.

In the practical embodiment by way of the example according to FIGS. 1 and 2, the sealing bars 44, 46 have a profile of a truncated triangle, the connecting piece is formed by a narrow stay, which has recesses 50 for the purpose of saving weight. In a practical embodiment by way of example the large radius R is equal to 60 millimeters, the small radius r is equal to 15 millimeters.

In the practical embodiment by way of the example according to FIG. 3 both sealing bars 44, 46 are tubes which are utilized simultaneously for the supply of a lubricant. The connecting pieces 48 are transversely extending tubes, which have aperatures for the egress of lubricant. Overall this sealing element 42 has the form of a ladder with spars having the profile of a truncated triangle and round rungs.

The aperatures for supplying lubricant are also shown in FIG. 6 as holes 102 running length wise through sealing elements 44, 46 and in FIG. 7 as aperatures 103 in connecting piece 48.

The practical embodiment by way of example in accordance with FIG. 4, a sealing element 42 is finally shown, in which the two sealing bars 44, 46 have a cross-section of a truncated triangle. The trunicated points of the parabolas point towards each other. The connecting piece 48 is once again arranged in the form of round rungs, these are connected at their one end rigidly with the lower sealing bar 44, however, protrude with their other end region through openings in the upper sealing bar 46. The terminate at the top in discs 52. Spiral compression springs 54 are arranged between these and the flat surface of the upper sealing bar 46, which springs press the two sealing bars 44, 46 up against each other. By this means it is brought about, as described above, that the two sealing bars 44, 46 are each in contact with the convex surfaces of the rotary pistons 26 and no play occurs as exists by necessity in the embodiment by way of example in accordance with FIGS. 2 and 3.

The rotary pistons 26 in the practical embodiment by way of example in accordance with FIG. 1 have a 120 degree rotational symmetry. Rotary pistons 26 with other rotational symmetries can also be used, for example with 180 degree rotational symmetry; on this subject reference is made to FIG. 5 and simultaneously to the application of the same date and by the same applicant "stirling machine . . . ", whose content belongs to the full scope of the disclosure of the present application, DE-A- NO. 3644833.8 Dec. 31, 1986.

The design of the front faces or cross-section surfaces of the rotary pistons 26 can be seen in FIG. 5 in the case of a 180 degree rotational symmetry. The rotary pistons' cross-sections shown there are essentially elliptical. The ellipse has two main semi-axes and two main secondaray axes, which in each case extend from the centre point, this being the intersection point of axis line 40 of the pertinent shaft 34 with the level of the paper. The two main semi-axes are positioned at 180 degrees to one another. In the illustration they extend from top to bottom. The two secondary semi-axes are also at an angle of 180 degrees to one another, they extend from left to right and at an angle of 90 degrees to the main semi-axes.

For the purpose of designing, a circle with a radius of $r_T$ is drawn about the axis line 40, which circle intersects the two main and secondary axis lines, which are at 90 degrees to one another, at a total of four points 56 to 62. An arc with the large radius R is drawn about the intersection points 56, 58 with the secondary axis lines. Circles with the small radius r are drawn about the two points 60, 62, these being the intersection points of the circle with radius $r_T$ with the two main axis lines. The radii are inter-related in terms of the following formula:

$$R-r=2r_T x \cos 90°/n.$$

In the practical embodiment by way of example in accordance with FIG. 1, n is equal to three, in the practical embodiment by way of example in accordance with FIG. 5, n is equal to two.

In the practical embodiment by way of example in accordance with FIG. 6 the sealing bars 44, 46 of the sealing element 42 each have the profile section of an isosceles triangle or a blunted triangle. The corners of the two triangles point towards each other, the bases 64 extend parallel to one another and at right-angles to a an interconnecting line 65 of the points located opposite to them. The two triangles are congruent. The projected distance of each of the parallel sides 66, 67 is designated by K on a line parallel to the bases 64. Phi is the angle between the interconnecting line 65 and the sides 66, 67.

$$\cos \text{phi} = \frac{r + R}{r + R + S' - K}$$

applies.

K may be positive, negative or zero; the positive case is shown in FIG. 6. The advantage of the arrangement in accordance with FIG. 6 lies in its exact fit. The connecting piece 48 can be executed optionally, e.g. as in the previously discussed practical embodiments by way of example.

I claim:

1. Rotary piston machine

A. with a piston assembly arranged in a gas-tight inner chamber of a housing, which arrangement is composed of at least three separate rotary pistons which are of identical design to one another, which are in the form of rectilinear prisms whose front faces are limited by arcs, whereby the radial spacing of the axis lines of the shafts is greater than the corresponding dimensions of the rotary pistons by the dimension of a gap S between adjacent rotary pistons, whereby a sealing element is allocated to each gap, which elements each have two sealing bars parallel to one another, which have a cross-section which is wider than the width S' of the gap S, which are in each case congruent, which are mutually linked by a connecting piece which is narrower than the width S' of the gap S and which have a length which corresponds substantially with the length of the rotary pistons, wherein the front faces of the rotary pistons are limited by several arcs which have two different radii, R, r of which the arc pieces with the same radius R or r each have arc lengths equal to one another, which are alternately placed in contact at connection points and tangentially blend into one another at these points, which are torsionally stiffly connected with the shafts respectively allocated to them, which shafts are rotatively mounted in the housing, extending along their geometric central axis, and are rotationally synchronized with each other by means of a gear, with which they are rotatable in the same direction of turn, which have front faces arranged flush with one another, and which limit laterally an inner working space by means of their curved peripheral surfaces, whereby the radial spacing of the axis lines of the shafts is greater than the sum (R+r) of the two different radii R, r by the dimension of a gap S between the adjacent rotary pistons, and the sealing bars each have the profile section of an isosceles, blunted triangle, whereby the corners of the triangle point towards each other, the bases extend parallel to one another and the relationship $$\cos \text{phi} = \frac{r + R}{r + R + S' - K}$$

applies for the angle phi between the connecting line of the opposing blunted corners of the isoceles triangle and its sides, whereby K is the distance between the respective parallel sides projected onto a line parallel to the bases, and K can be positive, negative or zero.

2. Rotary pistons machines according to claim 1, wherein the connecting piece is elastic.

3. Rotary piston machines according to claim 1, wherein the width of the connecting piece is five percent to fifty percent smaller than the width of the gap S.

4. Rotary piston machine according to claim 1, wherein the sealing bars have an oil boring for the supply of lubrication oil to the sealed zone between the rotary pistons.

5. Rotary piston machine according to claim 1, wherein equally as many sealing elements are provided as are rotary pistons.

6. Rotary piston machine according to claim 1, wherein the rotary pistons have a 180 degree to 120 degree rotational symmetry.

7. Rotary piston machine according to claim 1, wherein the sealing bars are pressed onto the rotary pistons by means of compression springs.

8. Rotary piston machine according to claim 1, wherein the sealing bars have flat seal surfaces in longitudinal direction, and with these are in contact with the rotary pistons.

9. Rotary piston machine according to claim 1, wherein the radii R and r of the arcs are related to one another in accordance with the formual $$R - r = 2r_T \times \cos \frac{90}{n}$$

whereby the center points of the arcs lie on main and secondary axis lines of the rotary piston cross-section, being similar to an ellipse, and being at a distance of $r_T$ from the axis line, whereby n is an integer.

* * * * *